United States Patent [19]

Suzuki et al.

[11] Patent Number: 4,517,110

[45] Date of Patent: May 14, 1985

[54] RUST PREVENTIVE AGENT OF HYDROXYPOLYBASIC ACID SALT TYPE

[75] Inventors: Hiroshi Suzuki; Yasuo Gama; Shoji Miyazaki, all of Higashi, Japan

[73] Assignee: Agency of Industrial Science and Technology, Tokyo, Japan

[21] Appl. No.: 551,728

[22] Filed: Nov. 15, 1983

[30] Foreign Application Priority Data

Nov. 15, 1982 [JP] Japan ..... 57-200181

[51] Int. Cl.[3] ..... C02F 5/10; C07C 61/09; C07C 62/04; C23F 11/12

[52] U.S. Cl. ..... 252/180; 252/396; 560/127; 562/509

[58] Field of Search ..... 252/180, 396; 560/127; 562/509

[56] References Cited

U.S. PATENT DOCUMENTS

| | | | |
|---|---|---|---|
| 3,444,237 | 5/1969 | Jaffe | 562/509 |
| 3,899,476 | 8/1975 | Ward | 562/509 |
| 4,021,376 | 5/1977 | Lamberti et al. | 252/180 |
| 4,043,930 | 8/1977 | Krueger et al. | 252/180 |

*Primary Examiner*—Paul Lieberman
*Assistant Examiner*—Robert A. Wax
*Attorney, Agent, or Firm*—Birch, Stewart, Kolasch & Birch

[57] ABSTRACT

A rust preventive agent comprising a salt of hydroxycarboxylic acid having a cyclohexane ring. This preventive agent has the advantages of low toxicity, safely, and low foaming, and additionally exhibits excellent rust preventive effect on various metals.

7 Claims, No Drawings

RUST PREVENTIVE AGENT OF HYDROXYPOLYBASIC ACID SALT TYPE

BACKGROUND OF THE INVENTION

This invention relates to a rust preventive agent comprising a novel hydroxypolybasic acid salt compound.

Various rust preventive agents have been proposed heretofore, but, preventives which exhibit low toxicity and are usable in a wide range of uses, are few, and no preventive which shows preventive effect for various kind of metals simultaneously is hitherto known. Examples of rust preventive agents of this kind include, petroleum sulfonic acid salt, sorbitan monooleic acid ester, metal soaps, etc. as oil-soluble rust preventive agents inorganic salts such as chromate, phosphate, and nitrite as water soluble rust preventive agent, and ethanolamine, benzotriazole, alkylphosphate-containing surface active agents, long chain quaternary ammonium halides, and higher amines, as water-oil soluble rust preventive agents. However, these rust preventive agents exhibit various disadvantages. That is, the solubility of some preventives is low in specific solvents, some are effective only on specific metals, and some preventives such as chromates cause the pollution which makes the preventives unusable in some cases. Furthermore, mixtures of a plurality of rust preventives have been proposed to eliminate above mentioned disadvantages, but the mixing not always results in the production of a rust preventive agent which exhibits an integrated advantage of each preventive. In some cases both preventives are immiscible with each other but mixtures exhibit disadvantages of each preventive, the life of effect is shortened, and some mixtures may yield carcinogens. For example, a mixture of nitrites and lower amines yields nitrozoamines.

Some of the inventors of this application had investigated the method for production of hydroxycarboxylic acids and esters thereof. This was followed up with the hard investigation of the application of the hydroxycarboxylic acids and esters thereof, and found that some kinds of salt having a cyclohexane ring exhibit practical advantages such as low toxicity, safety, and low-foaming, and additionally excellent rust preventive properties for various metals. Thus, this invention has been determined on the basis of this observation.

BRIEF SUMMARY OF THIS INVENTION

This invention provides a rust preventive agent comprising salts of hydroxycarboxylic acids having a cyclohexane ring.

An object of this invention is to provide a rust preventive agent of low toxicity and excellent rust preventive properties.

Another object of this invention is to provide a rust preventive agent which is effective on a wide range of metals.

Other objects and advantages of the invention will become apparent during the following description.

DETAILED DESCRIPTION OF THE INVENTION

The rust preventive agent of this invention comprises salts of hydroxycarboxylic acid represented by the general formula;

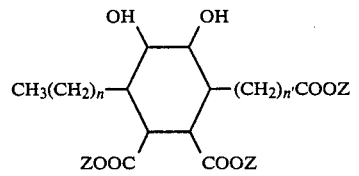

(I)

wherein n and n' are integers from 4 to 10, each each Z is selected from the group consisting of hydrogen, lower alkyl group, alkali metal, or ammonium ion, which may be either the same or different from each other, at least one of the Zs being an alkali metal such as sodium, potassium, lithium and the like or ammonium ion.

In the compound represented by the above mentioned general formula (I), n and n' are integers from 4 to 10, and preferably from 4 to 7. If n and n' are less than 4, rust preventive power of the compound is not so high, and more than 10, the compound is not suitable due to lathering and lowering of stability in hard water.

When the Zs are alkyl groups, the number of carbon atoms ranges usually from 1 to 8, and preferably from 1 to 4.

When the Zs in the compound of the above mentioned general formula (I) of this invention are alkali metal or ammonium ion, if the proportion of alkali metal or ammonium ion decreases and the proportion of alkyl group and/or chain length thereof increases, an oil-soluble rust preventive agent of relatively low pH is obtained.

The salt of hydroxycarboxylic acid represented by the above mentioned general formula (I) is prepared by the following method.

Tricarboxylic acid or ester thereof having a cyclohexene ring represented by the general formula;

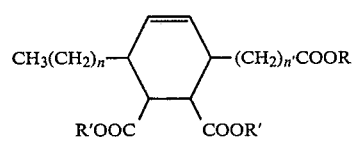

(II)

wherein n and n' are integers from 4 to 10, and R and R' are selected from the group consisting of hydrogen atom and alkyl group having carbon number of 1 to 8; is oxidized by conventional hydrogen peroxide or potassium permanganate method to obtain dihydroxycarboxylic acid or an ester thereof represented by the general formula;

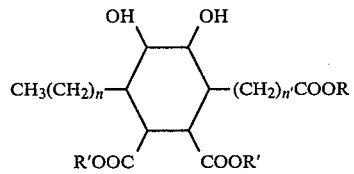

(III)

wherein n, n', R and R' have the same meaning as defined in the above.

Then, the dihydroxycarboxylic acid or ester thereof represented by the above mentioned general formula (III) is neutralized or saponified by a conventional method to obtain the named salt represented by the above mentioned general formula (I). Examples of alkali used for neutralization or saponification include sodium hydroxide, potassium hydroxide, lithium hydroxide, and ammonia.

Of course, in the preparation process of the salt of this hydroxycarboxylic acid, the carboxyl group can be esterified at the desired position suitably to form the ester group.

Fatty acid derivaties having a cyclohexene ring represented by the above mentioned general formula (II) may be synthesized through Diels-Alder addition of maleic acid or diester of maleic acid to conjugate octadecadiene acid or ester thereof (for example, Japanese Pat. Nos. 936581, 933724, and U.S. Pat. No. 4,150,041). However, other derivatives synthesized through other methods may be used as the raw material for this invention.

Heretofore, derivatives of straight chain carboxylic acid in which hydroxy groups are directly combined to the carbon chain of straight carboxylic acid are widely known as hydroxycarboxylic acid or ester thereof. On the other hand, as polycarboxylic acid or ester thereof having a ring structure in the molecule, dicarboxylic acid, tricarboxylic acid, and ester thereof having a cyclohexene ring which is synthesized using linoleic acid or ricinoleic acid as a starting material were reported recently (for example, J. Colloid Interface Science, 60, 148 (1977), J. Am. Oil Chem. Soc., 52, 219 (1975), Japanese Pat. No. 936581, U.S. Pat. No. 4,150,041).

However, tricarboxylic acid, a salt thereof, or ester thereof having both a cyclohexane ring and hydroxyl groups represented by above mentioned general formula (I) has never been known.

The salt, an effective component of this invention represented by above mentioned general formula (I) has such a unique structure that a cyclohexane ring is at the center of the molecule, hydrogen atoms of the molecule being substituted with hydroxyl groups, carboxyl groups, and long chain alkyl groups, and that the molecule has two hydroxy groups and three carboxyl groups therein. Thus this compound is greatly polar.

The rust preventive agent of this invention can be used in various ways, for example, in a form of an aqueous solution. Usually the concentration of the aqueous solution ranges from 0.001 to 3.0% by weight, preferably from 0.05 to 1.5% by weight.

The rust preventive agent of this invention exhibits low toxicity and extraordinary rust preventive effect. Particularly, the rust preventive shows superior effect for the many kinds of metals such as soft iron, steel, aluminum, brass, copper, tin plate, zinc, and solder.

The rust preventive agent of this invention may be used independently, and of course may be suitably used jointly with other known rust preventives.

To further illustrate this invention, and not by way of limitation, the following Examples are given.

Salts of hydroxycarboxylic acid used in examples were prepared according to Reference Examples 1 to 3 described, and the test for rust preventive property was performed by the method described in Example 2.

The starting material used in the Reference Examples was a fatty acid derivative having a cyclohexane ring with a structure represented by the general formula (II),

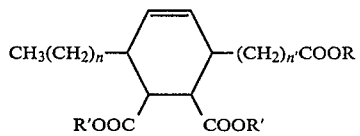

(II)

Specified n, n', R, and R' are shown in each description of Reference Examples.

REFERENCE EXAMPLE 1

According to hydrogen peroxide oxidation method, 5.1 g of raw material (n=5, n'=7, and both R and R' are $CH_3$ in the above formula (II).) was oxidized, and 4.7 g of reaction product was obtained (yield: 93.9%). The reaction product was subjected to various analyses and the following results were obtained.

Neutralization number: 389.0 (theoretical value: 390.9), hydroxyl value: 262.1 (theoretical value: 260.6), IR spectrum ($cm^{-1}$): 3200–3600 (OH group), 1720 (carbonyl group), $^1$H-NMR spectrum (ppm): 0.88 (terminal $CH_3$ group), 1.3 ($CH_2$ group), 9.0 (COOH group), $^{13}$C-NMR spectrum (ppm): 14.2 (terminal methyl group), 23.1 to 45.4 ($CH_2$ and $CH_3$ group), 73.1–73.4 (CH groups substituted on OH group), 175.5–175.7 (Carbonyl group).

From above mentioned analytical results it was identified that the reaction product was 8-(2,3-dicarboxy-4-hexyl-5,6-dihydroxy-1-cyclohexyl)octanoic acid having the following structure.

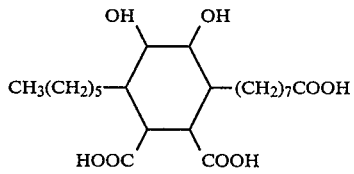

REFERENCE EXAMPLE 2

In the same manner as described in Reference Example 1, 5.5 g of raw material (n=4, n'=8, and both R, and R' are $CH_3$ in the above formula (II).) was treated and 5.2 g of reaction product was obtained (yield: 96.3%). The reaction product was variously analyzed, and results similar to Reference Example 1 was obtained. Accordingly, it was identified that the reaction product was 8-(2,3-Dicarboxy-4-pentyl-5,6-dihydroxy-1-cyclohexyl) nonanoic acid having the following molecular structure.

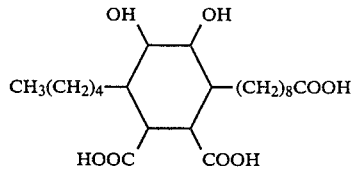

REFERENCE EXAMPLE 3

According to potassium permanganate oxidation method, 4.0 g of raw material (n=5, n'=7, and both R, R' are H in the above formula (II).) was treated, and 3.7 g of reaction product was obtained (yield: 85.0%). It was identified that the reaction product was 8-(2,3-dicarboxy-4-hexyl-5,6-dihydroxy-1-cyclohexyl) octanoic acid by the same analysis as mentioned in Reference Example 1. 3.0 g of this reaction product was subjected to methyl esterification to form an ester by a conventional method (3.2 g, yield: 96.8%). The ester value of this ester was 360.4 (theoretical value; 356.2), and it was identified that the product was trimethyl ester of above mentioned tricarboxylic acid represented by the following formula.

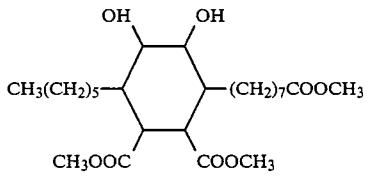

EXAMPLE 1

In 25 ml of formic acid, 10 mmol of the ester obtained in Reference Example 3 was dissolved. To the ester solution 6 ml of hydrogen peroxide solution (30%) was added dropwise for the duration of 25 min. with stirring at 20±2° C. Elevating the reaction temperature to 40° C., the reaction was continued for 3.5 hr with stirring. After the reaction, the solution was poured into water and extracted with ether to collect and purify the reaction product. Then, the reaction product was treated with a NaOH solution (6 g/60 ml $H_2O$) for 4 hrs at 90° to 95° C. under stirring, and dry ice was added under slightly warming to convert excessive NaOH to $Na_2CO_3$. Then, water was evaporated from the solution until the volume decreased to about 30 ml, and 150 ml of methanol was added to it. The separating $Na_2CO_3$ was filtered off. The filtrate soap solution was evaporated to dry, and the resultant dry substance was dissolved in 100 ml of hot methanol. Into the solution 200 ml of ethanol was added, and separating precipitate ($Na_2CO_3$) was filtered off, 200 to 250 ml of ether was added to the filtrate. The soap was purified by recrystallization with the same solvent system. Obtained soap was subjected to analyses (infra-red spectrometry, nuclear magnetic absorption spectrometry, and elemental analysis). As a result, the compound (soap) having the following structure was identified.

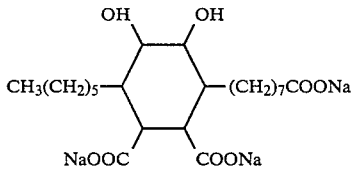

The analytical results of the soap; IR ($cm^{-1}$): 3600 (OH group), 1565 (COONa group); 'H-NMR (δ): 1.4 ($CH_3$ group), 1.8 ($CH_2$ group), 2.7 (CH combined with COONa), 3.9 to 4.6 (CH combined with OH); $^{-}$C-NMR (δ): 14.3 ($CH_3$ group), 22.9 to 49.0 ($CH_2$, and CH group), 183.0 to 184.3 (COONa group) Na%: 13.96 (theoretical value: 13.89).

EXAMPLE 2

A. Test method for rust preventive property (1) 4 ml of sample solution was put into a test tube (ϕ10×70 mm) with a cap, and sample pieces of 5 kinds of metals (metal plate of 3×20×0.8 or 1.6 mm) were simultaneously soaked in the solution and shaked at 90° C. for 24 hr, being soaked in the solution, taken off, air dried, and stood in in an atmosphere of 93% relative humidity at the room temperature (20° to 25° C.) for a prescribed days, and then the change of the metal pieces was observed with naked eye for evaluation.

The standard of evaluation is as follows:

| Evaluation | The state of surface |
|---|---|
| 5 | No change |
| 4 | Slight reduction of the luster, pitting corrosion on limited portion, or slight turbidity in the solution. |
| 3 | Somewhat increased change of 4 |
| 2 | Considerable change, or rust on ½ surface. |
| 1 | Serious change, rust on entire surface, remarkable change of solution and formation of precipitate. |

(2) 7 g of sample aqueous solution was put into a test tube of the same kind as used in test method 1), metal pieces of three kinds (8×40×1 mm, steel (B, described later), copper, and aluminum) were soaked respectively, and stood at 30±1° C. for 10 days. Then the metal pieces were wiped lightly with gauze, washed with water and acetone, dried, and the weight change was measured and the change of appearance was observed with naked eyes for evaluation. Oxygen was passed into the solution during the measurement with the cap on it, and water equal to the evaporated was supplied during the measurement. The kinds of metals used for testing are shown in Table 1.

B. A rust preventive agent aqueous solution of prescribed concentration was prepared using 3-Na salt obtained in Example 1. The rust preventing properties were measured according to the test method (1), and results are shown in Table 2.

From this table, it is apparent that the preventive is remarkably effective on steel under every conditions, somewhat inferiorly effective on copper-containing metals, that is, more inferiorly effective on copper than on brass, and excellently effective on aluminum under every conditions.

EXAMPLE 3

An aqeuous solution of rust preventive agent of prescribed concentration was prepared using 3-Na salt. The rust preventive properties were measured according to the test method (2), and results are shown in Table 3.

From this table, it is apparent that good results are obtained for all cases excepting slight change of color on copper and slight weight increase of aluminum.

Accordingly, the rust preventive agent of this invention exhibits excellent effect on steel under all conditions, and considerably excellent effect on aluminum, excepting somewhat inferior effect on copper-containing metals under high temperature and humidity conditions.

TABLE 1

| Metal | Name | Use | Test No. | JIS No. |
|---|---|---|---|---|
| Aluminum | High strength aluminum alloy | For anti-freeze | | JIS H4000 A20241P |
| Steel (A) | Rolled steel for general structure | | JIS K2234 | JIS G3101 SS-41 |
| Steel (B) | Cold rolled | | JIS | JIS G3141 SPCCB |

TABLE 1-continued

| Metal | Name | Use | Test No. | JIS No. |
|---|---|---|---|---|
| | steel | | Z0236 | |
| Copper | | For anti-freeze | K2234 | JIS H3101 TCUP1 |
| Brass | | For anti-freeze | K2234 | JIS H3201 BISP3 |

TABLE 2

| | | 90° C. | | R.H. 93%, 20-25° C. | | | | | |
|---|---|---|---|---|---|---|---|---|---|
| | | day | | | | | | | |
| | | 1 | | 1 | | 3 | | 10 | |
| | Metal | % | | | | | | | |
| Sample | piece | 1.0 | 0.1 | 1.0 | 0.1 | 1.0 | 0.1 | 1.0 | 0.1 |
| 3-Na | Steel (A) | 5 | 5 | 5 | 5 | 5 | 5 | 5 | 5 |
| salt | Steel (B) | 5 | 5 | 5 | 5 | 5 | 5 | 5 | 5 |
| | Copper | 4 | 3 | 4 | 5 | 4 | 4 | 4 | 4 |
| | Brass | 4 | 5 | 5 | 5 | 5 | 4 | 4 | 4 |
| | Aluminum | 5 | 5 | 5 | 5 | 5 | 5 | 5 | 5 |
| Distilled | Steel (A) | 1 | | 5 | | 4 | | 4 | |
| water | Steel (B) | 1 | | 4 | | 4 | | 3 | |
| | Copper | 3 | | 5 | | 5 | | 5 | |
| | Brass | 2 | | 5 | | 5 | | 5 | |
| | Aluminum | 2 | | 5 | | 5 | | 5 | |

TABLE 3

| | | 0.5% | | |
|---|---|---|---|---|
| Sample | Metal piece | ΔWt* | Appearance | Aqueous solution |
| 3-Na | Steel (B) | 0 | 5 | 5 |
| salt | Copper | −0.001 | 4 | 5 |
| | Aluminum | +0.003 | 5 | 5 |
| Distilled | Steel (B) | −0.034 | 2 | 2 |
| water | Copper | +0.001 | 5 | 5 |

TABLE 3-continued

| | | 0.5% | | |
|---|---|---|---|---|
| Sample | Metal piece | ΔWt* | Appearance | Aqueous solution |
| | Aluminum | +0.133 | 3 | 3 |

*Change of weight g/10 cm$^2$

What is claimed is:

1. A rust preventive agent comprising salt of hydroxycarboxylic acid represented by the general formula;

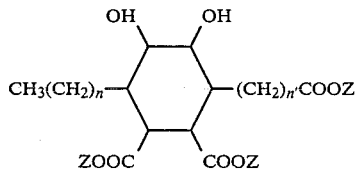

wherein n and n' are integers from 4 to 10, and each Z is selected from the group consisting of hydrogen, lower alkyl group, alkali metal, or ammonium ion, which may be either the same or different from each other, at least one of Zs being alkali metal or ammonium ion.

2. The rust preventive agent comprising salts of hydroxycarboxylic acid of claim 1, wherein each Z is an alkali metal.

3. The rust preventive agent comprising salts of hydroxycarboxylic acid of claim 1, wherein each Z is an ammonium ion.

4. The rust preventive agent comprising salts of hydroxycarboxylic acid of claim 1, wherein n and n' are integers from 4 to 7.

5. The rust preventive agent comprising salts of hydroxycarboxylic acid of claim 1, wherein the lower alkyl group contains from 1 to 8 carbon atoms.

6. The rust preventive agent comprising salts of hydroxycarboxylic acid of claim 1, wherein the alkali metal is sodium, potassium or lithium.

7. The rust preventive agent comprising salts of hydroxycarboxylic acid of claim 1, wherein the low alkyl group contains from 1 to 4 carbon atoms.

* * * * *